US005686796A

United States Patent [19]

Boswell et al.

[11] Patent Number: 5,686,796

[45] Date of Patent: Nov. 11, 1997

[54] ION IMPLANTATION HELICON PLASMA SOURCE WITH MAGNETIC DIPOLES

[75] Inventors: Roderick William Boswell, O'Connor, Australia; Albert Rogers Ellingboe, Freemont, Calif.; John Howard Keller, Newburgh, N.Y.

[73] Assignee: International Business Machines Corporation, Armonk, N.Y.

[21] Appl. No.: 575,453

[22] Filed: Dec. 20, 1995

[51] Int. Cl.[6] ..... H05H 1/24

[52] U.S. Cl. ..... 315/111.51; 313/231.31; 118/723 I; 204/298.37

[58] Field of Search ..... 315/111.21, 111.41, 315/111.71, 111.81, 111.51; 313/231.31; 118/723 F; 204/298.37

[56] References Cited

U.S. PATENT DOCUMENTS

| | | | |
|---|---|---|---|
| 4,745,337 | 5/1988 | Pichot et al. | 315/111.41 |
| 4,810,935 | 3/1989 | Boswell | 315/111.41 |
| 4,990,229 | 2/1991 | Campbell et al. | 204/298.06 |
| 5,032,202 | 7/1991 | Tsai et al. | 156/345 |
| 5,081,398 | 1/1992 | Asmussen et al. | 315/111.41 |
| 5,122,251 | 6/1992 | Campbell et al. | 204/298.06 |
| 5,133,825 | 7/1992 | Hakamata et al. | 156/646 |
| 5,203,960 | 4/1993 | Dandl | 156/643 |
| 5,304,279 | 4/1994 | Coultas et al. | 156/345 |
| 5,304,282 | 4/1994 | Flamm | 156/643 |

FOREIGN PATENT DOCUMENTS

| | | | |
|---|---|---|---|
| 6-151090 | 5/1994 | Japan | 315/111.41 |

OTHER PUBLICATIONS

IBM Technical Disclosure Bulletin, vol. 35, No. 5, Oct. 1992, J. J. Cuomo et al., *Compact Microwave Plasma Source*, pp. 307–308.

*Primary Examiner*—Robert Pascal
*Assistant Examiner*—Justin P. Bettendorf
*Attorney, Agent, or Firm*—Ira D. Blecker

[57] ABSTRACT

Disclosed is an ion implantation source for producing a plasma with an electron cyclotron resonance zone including a chamber for plasma processing and having at least one extraction slit, said extraction slit situated at a first end of the chamber; at least one antenna encircling the chamber for prodding a radio frequency induced electromagnetic field to generate an inductive/helicon plasma within the chamber; a plurality of magnetic dipoles at the periphery of the chamber; and at least one magnetic dipole at a second end of the chamber; the magnetic dipoles at the periphery and second end of the chamber having their fields directed towards the interior of the chamber, wherein the fields are adjacent to the periphery and the second end of the chamber and keep the plasma spaced from the periphery and the second end of the chamber.

15 Claims, 5 Drawing Sheets

ION IMPLANTATION HELICON PLASMA SOURCE WITH MAGNETIC DIPOLES

RELATED APPLICATIONS

This application is related to "Helicon Plasma Processing Tool and Ion Beam Source Utilizing an Induction Coil," U.S. patent application Ser. No. 08/575,431 (IBM Docket No. FI9-95-086), filed even date herewith.

BACKGROUND OF THE INVENTION

This invention relates to apparatus for plasma processing of substrates. More particularly, the invention relates to subtractive (etching) and additive (deposition) processing of electronic circuit chips and packaging materials and, most particularly, to ion implantation.

Plasma discharges are extensively utilized in the fabrication of devices such as semiconductor devices and, in particular, silicon semiconductor devices. By selecting appropriate operating conditions, plasma discharges in appropriate precursor gases may be utilized to induce formation of a solid on a deposition substrate or to remove selected portions from an etched substrate.

In etching, for example, a pattern is etched into the substrate by utilizing a mask having openings corresponding to this pattern and a suitable plasma. It is desirable to produce etching at an acceptable etch rate. The acceptable etch rate depends upon the material to be removed. Additionally, the production of a relatively high etching rate leads to shorter processing times.

In plasma-assisted deposition procedures, the desired solid is commonly formed by a reactant gas introduced into an evacuated chamber which is immersed in a steady magnetic field and exposed to electromagnetic radiation. For example, a deposition substrate is surrounded by a plasma which supplies charged species for energetic ion bombardment. The plasma tends to aid in rearranging and stabilizing the deposited film provided the bombardment is not suffciently energetic to damage the underlying substrate or growing film.

Various apparatus for producing the desired plasma discharges have been employed.

Plasma sources employing electron cyclotron resonance (ECR) heating comprise, for example, the deposition on and etching of substrates as explained above. ECR/helicon/magnetron plasma sources such as those provided by the present invention and the prior art discussed below employ magnetic fields and a suitable power source to create chemically active plasmas, preferably at very low gas pressures. Low pressure operation is desirable in order to permit the formation of highly directional or anisotropic streams of low temperature ions which are uniform over substantial transverse dimensions larger than the sample being processed.

Electrons in the interaction region gain kinetic energy from the electromagnetic radiation, and if the radiation power and the gas pressure are suitably adjusted, the heated electrons may ionize the reactant gas molecules to create a plasma. The plasma ions and electrons flow out of the resonant interaction region and impinge on a substrate where the ions can be used for etching of existing films on selected portions of a substrate or deposition of new materials. If the plasma density is sufficiently high, the deposition can be rapid or the etch rates can be rapid, selective and stable, and if the ion and electron energies are sufficiently low, damage to the sample being processed is prevented.

Inductive and ECR plasma generation techniques are capable of producing efficient plasmas at low pressures with much higher densities compared to the conventional RF discharge or non-ECR microwave plasma techniques. The ECR/helicon enhancement also extends the operating process pressure domain down to very low pressures in the high vacuum regime. Inductive and ECR plasma processing is applicable to a wide range of advanced semiconductor device, flat panel and packaging fabrication processes.

Boswell U.S. Pat. No. 4,810,935, the disclosure of which is incorporated by reference herein, discloses a plasma processing apparatus comprising an RF antenna and a DC magnetic field coil to produce a magnetoplasma which is expanded into a larger magnetoplasma which can be used for etching of semiconductor material and polymers and for surface treatments of other materials.

Coultas et al. U.S. Pat. No. 5,304,279, the disclosure of which is incorporated by reference herein, discloses a multipole plasma processing tool wherein an RF coil is situated on top of the plasma processing chamber with a plurality of dipole magnets surrounding the plasma processing chamber. Optionally, there may be additional multipole magnets situated adjacent to the RF coil on top of the plasma processing chamber.

Flamm U.S. Pat. No. 5,304,282, the disclosure of which is incorporated by reference herein, discloses a plasma etching and deposition apparatus which comprises an helical coil, means for applying an RF field to the coil and an applied magnetic field.

Campbell et al. U.S. Pat. Nos. 5,122,251 and 4,990,229, the disclosures of which are incorporated by reference herein, disclose a plasma etching and deposition apparatus which comprises an RF-powered antenna to form a non-uniform plasma in an upper plasma chamber which is isolated from the walls of the upper plasma chamber by magnetic coils. The plasma eventually is expanded and made uniform in a lower plasma chamber.

Dandl U.S. Pat. No. 5,203,960, the disclosure of which is incorporated by reference herein, discloses a plasma etching and deposition apparatus comprising a plasma chamber surrounded by a plurality of permanent magnets. Microwave power is injected through slotted waveguides perpendicularly to the longitudinal axis of the plasma chamber.

Assmussen et al. U.S. Pat. No. 5,081,398, the disclosure of which is incorporated by reference herein, discloses a plasma etching and deposition apparatus comprising a quartz plasma chamber wherein microwave power is injected by a coaxial waveguide. Permanent magnets are situated adjacent to the plasma chamber and the region where the electron cyclotron resonance is formed.

Hakimata et al. U.S. Pat. No. 5,133,825, the disclosure of which is incorporated by reference herein, discloses a plasma generating apparatus wherein microwave power is injected coaxially into the plasma chamber. Permanent magnets are directly adjacent to and surround the plasma chamber.

Tsai et al. U.S. Pat. No. 5,032,202, the disclosure of which is incorporated by reference herein, discloses a plasma etching and deposition apparatus comprising a microwave source which forms a plasma in an upper plasma chamber. The plasma is confined by solenoid magnets. The plasma drifts and is expanded in a lower plasma chamber which is surrounded by line cusp permanent magnet columns.

Pichot et al. U.S. Pat. No. 4,745,337, the disclosure of which is incorporated by reference herein, discloses a plasma generating apparatus comprising a microwave source having its antenna within the plasma chamber. IBM Technical Disclosure Bulletin, 35, No. 5, pp. 307–308

(October 1992), the disclosure of which is incorporated by reference herein, is similar to Pichot in that the microwave antenna is located in the plasma chamber.

Notwithstanding the many prior art references, there remains a need for a plasma generating apparatus which efficiently produces a quiescent plasma that runs at low pressures and is stable at electron densities of $10^{10}$ and $10^{11}$ electrons/cc.

Accordingly, it is a purpose of the present invention to have a plasma generating apparatus which produces a uniform, quiescent plasma.

It is another purpose of the present invention to have a plasma generating apparatus which is of high efficiency.

It is yet another purpose of the present invention to have a plasma generating apparatus which runs at low pressures in the range of 1–5 mTorr.

These and other objects of the present invention will become more apparent after referring to the following detailed description of the invention considered in conjunction with the accompanying drawings.

BRIEF SUMMARY OF THE INVENTION

The objects of the invention have been achieved by providing an ion implantation source for producing a plasma with a resonance zone comprising:

a chamber for plasma processing and having at least one extraction slit, said extraction slit situated at a first end of said chamber;

at least one antenna encircling said chamber for providing a radio frequency induced electromagnetic field to generate an inductive/helicon plasma within said chamber;

a plurality of magnetic dipoles at the periphery of said chamber; and at least one magnetic dipole at a second end of said chamber;

said magnetic dipoles at the periphery and second end of said chamber having their fields directed towards the interior of said chamber, wherein said fields are adjacent to the periphery and said second end of said chamber and keep said plasma spaced from said periphery and said second end of said chamber.

DETAILED DESCRIPTION OF THE INVENTION

Figure 1:
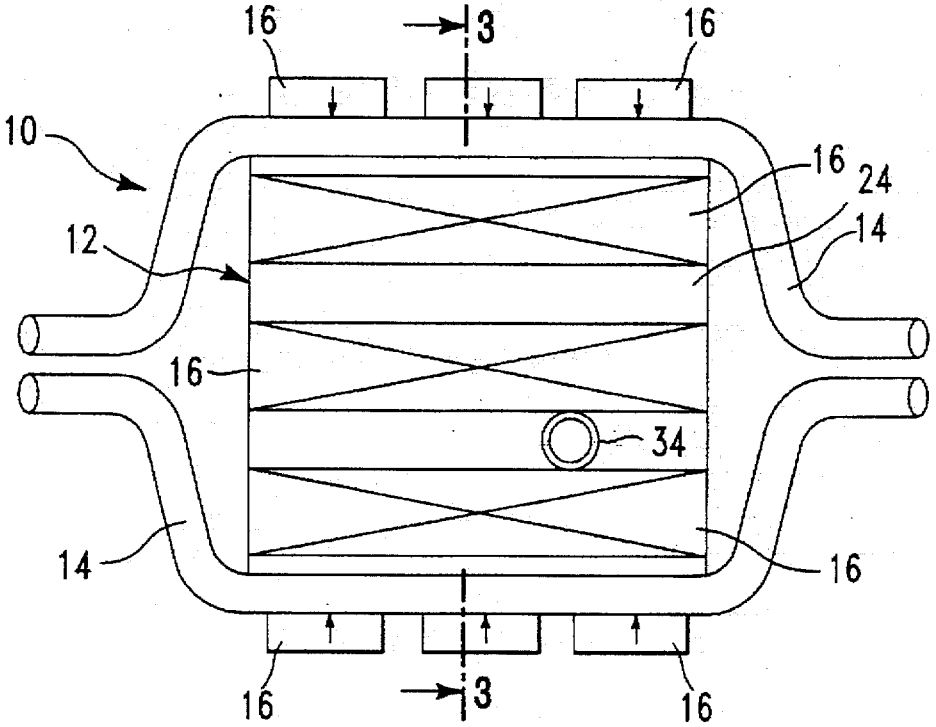
FIG. 1 is a view of an ion beam source according to the present invention.
Figure 3:
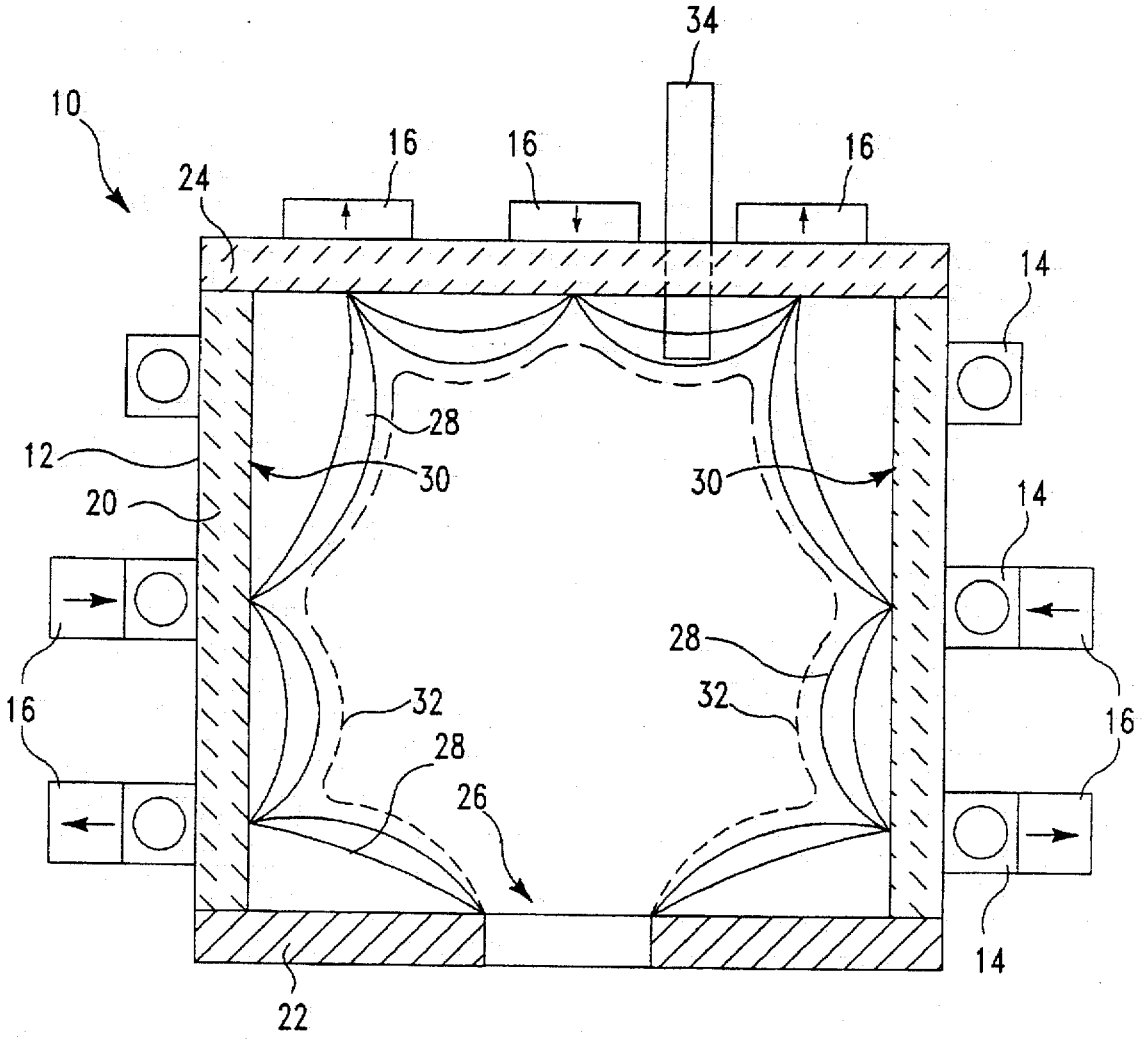
FIG. 3 is a sectional view of the ion beam source in FIG. 1 in the direction of arrows III—III.

Referring to the drawings in more detail, and particularly referring to FIGS. 1 and 3, there is shown an ion beam source, generally indicated by 10, for producing a plasma with a resonance zone. The apparatus 10 includes a chamber 12, at least one antenna 14 and a plurality of magnetic dipoles 16.

The chamber 12 is most preferably utilized for ion implantation. The workpiece may be, for example, a semiconductor wafer. As shown in FIG. 3, the chamber 12 consists of a vertical section 20, a base section 22 and a top section 24. The base section 22 has an extraction slit 26 (sometimes interchangeably called an extraction aperture).

Figure 6:
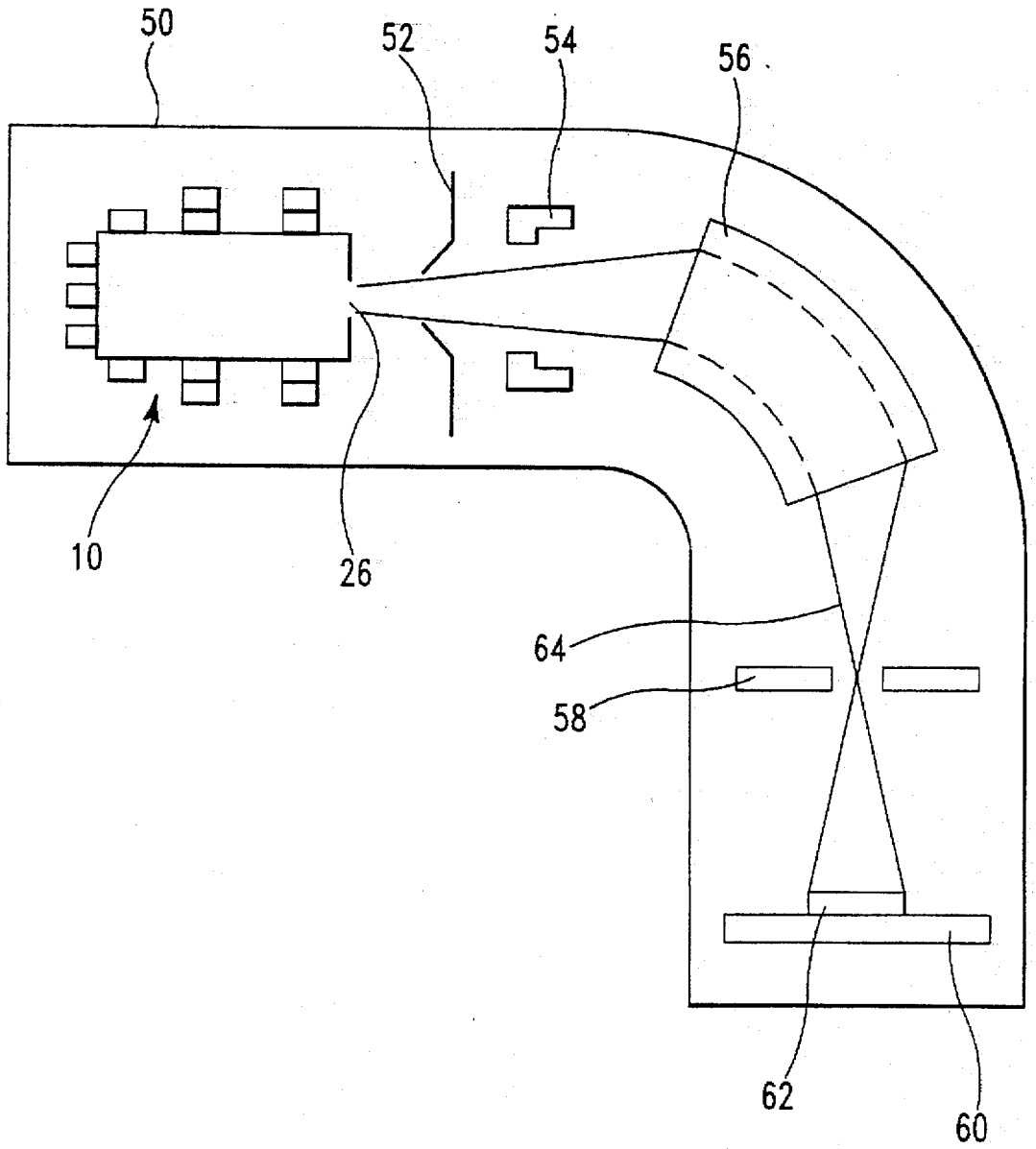
FIG. 6 is a schematic view of the ion beam source, according to the present invention, with associated apparatus in its operating environment.

Referring now to FIG. 6, generally surrounding the ion beam source 10 is vacuum chamber 50. Downstream of the ion beam source 10 and also included within the vacuum chamber 50 are associated apparatus such as accel/suppression electrode 52, decel/ground electrode 54, mass analysis magnet 56, mass slit 58 and a suitable workpiece holder or table. The workpiece 62 sits on the workpiece holder or table 60 and is impinged by the ion beam 64 extracted through extraction slit 26.

Figure 2:
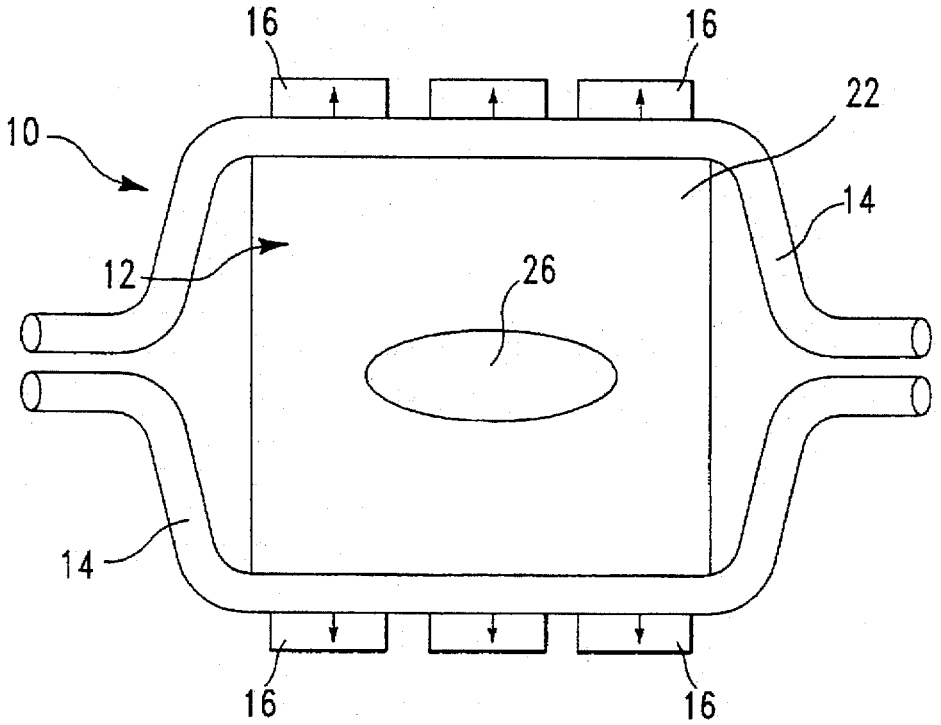
FIG. 2 a bottom view of the ion beam source according to the present invention.
Figure 7:
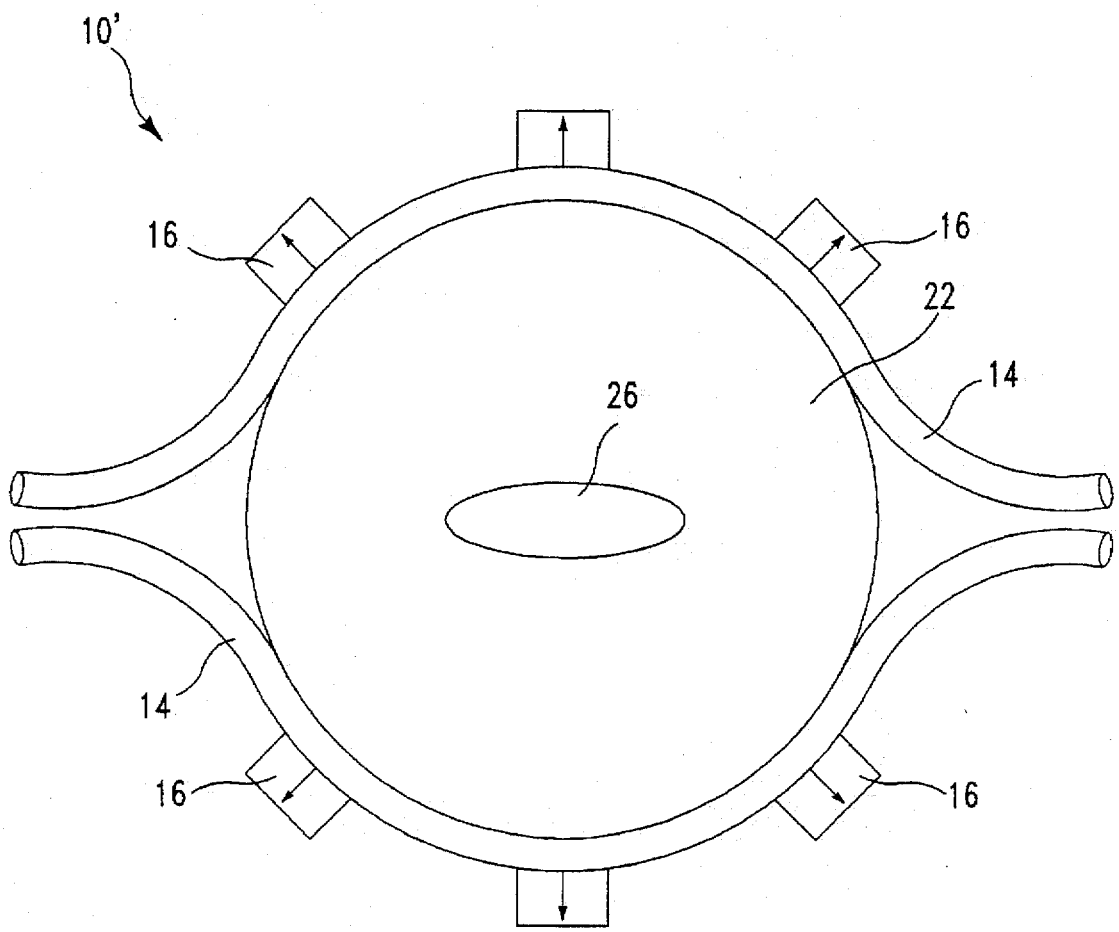
FIG. 7 is a bottom view of the ion beam source similar to FIG. 2 except that the chamber is circular in cross-section.

Referring now back to FIGS. 1 to 3, the chamber 12 may be any shape such as circular, square or rectangular, although it is preferred that it be rectangular for rectangular beams. In an alternative embodiment of the invention, as shown in FIG. 7, the chamber 22 of apparatus 10' may be circular in cross-section. Since the plasma source can get quite hot, e.g., 500–1000 degrees Centigrade, the chamber 12 should be made from materials that are resistant to such high temperatures. The chamber 12 may be made of a variety of materials such as boron nitride, aluminum nitride, molybdenum, tungsten or graphite, to name a few. It is important, however, that the portions of the chamber adjacent to the at least one antenna 14 and magnetic dipoles 16 should be transparent to the magnetic field 28 from the magnetic dipoles 16 and the electromagnetic energy from the at least one antenna 14. For purposes of illustration and not limitation, the chamber 12, or at least the portions of it adjacent to the at least one antenna 14 and magnetic dipoles 16, may be made from, e.g., boron nitride.

As is apparent from FIG. 1, the at least one antenna 14 encircles the chamber 12. It is preferred that the at least one antenna 14 is located on the exterior of the chamber 12 so as to avoid any contamination of the plasma and reduce the heat load to the antenna. A suitable gas (not shown) is introduced into the chamber 12 through tube 34. Suitable gases include, for example, $BF_3$, As, P, $SiF_4$, $SiH_4$, $O_2$, and $N_2$+$H_2$. The gas may be obtained from a gas container or may be formed by heating up a solid, such as arsenic or phosphorus, to generate the gas. Preferably, the pressure of the gas in chamber 10 is at a low pressure of about 1–5 mTorr. The at least one antenna 14 provides a radio frequency (RF) induced field to generate within the chamber 12 a helicon or inductive plasma. Electrical power may be supplied to the at least one antenna 14 by a source (not shown) connected to the at least one antenna 14. The at least one antenna 14 is energized by a 13.56 MHz radio frequency source with a power of about 500 watts. Other radio frequencies such as 400 KHz–80 MHz may also be utilized. The RF energy from the at least one antenna 14 ionizes the gas in chamber 12 into a sustained inductive/helicon plasma for producing an ion beam.

There may be only one antenna 14 encircling the chamber 12. However, as shown in FIG. 3, there are a plurality of antennas 14 encircling the chamber 12. The number of antennas 14 as well as the magnetic dipoles 16 associated with the antennas 14 will be dictated by the particular application, the efficiency of the apparatus 10 in generating the plasma, and the density of the plasma that is needed.

To aid in the extraction of the ion beam, the plasma can be made more quiescent by driving the antenna nearly symmetrically to reduce the RF noise coupled to the plasma. Harmonic noise can also be reduced by the capacitance to local ground which is seen by both ends of the antenna structure.

One may also use capacitance between sections of the antenna for reducing either the capacitive coupling or reducing the amount of RF noise in the plasma near the extraction slit. In this way, high current density beams can be produced which are easily transported to the workpiece 62 and through any beam line components such as, for instance, a mass analysis magnet.

There are a plurality of magnetic dipoles 16 around the periphery of the chamber 12 and at least one magnetic dipole, but more preferably, a further plurality of magnetic dipoles 16 at the top 24 of the chamber 12. The plurality of magnetic dipoles 16 are made from permanent magnets, such as barium ferrite, strontium ferrite or samarium cobalt, instead of being electromagnets. As can be seen, the plurality of magnetic dipoles 16 have their north and south poles oriented toward the interior of the chamber 12. The magnetic fields 28 of the plurality of magnetic dipoles 16 are confined adjacent to the walls 30 (i.e., the periphery) of the chamber 12. With this arrangement, the plurality of magnetic dipoles 16 provide a wall of magnetic field forces which repel electrons back into the interior of chamber 12, thereby reducing the number of activated ions striking the walls 30 of the chamber 12 and varying the uniformity of concentration of plasma near the extraction slit 26. In this way, the magnetic fields 28 keep the plasma spaced from the walls 30 of the chamber 12 and greatly reduce the current to the periphery and the top section 24 of the chamber 12. The combination of the magnetic fields 28 and the inductive/helicon plasma generated by the at least one antenna 14 form ECR region 32. The multipole confined plasma according to the present invention produces a quiescent plasma from which high density ion beams can be extracted.

Further according to the present invention, the at least one antenna 14 together with the plurality of magnetic dipoles 16 produce a plurality of inductive/helicon wave plasma sources in which the magnetic field varies from a value which is large enough to confine the plasma away from all the surfaces where the plasma is not being used and decreasing to the electron cyclotron field where the high density plasma is produced or where the plasma is to be used. The plasma is produced near the extraction region while the magnetic field near the other surfaces reduces the plasma diffusing to surfaces where it is not used, thereby leading to the very high efficiency of the present invention. The magnetic field value will depend on the intended operating pressure and the desired confinement, but in general should be greater than 500 Gauss. The resonant field is 5 Gauss at 13.56 MHz and 15 Gauss at 40 MHz.

The magnetic field at the extraction slit can be made on the order of 50 Gauss in order to enhance the decomposition of the feed gas and thus produce, for example, $B^+$ from $BF_3$ or $Si^+$ from $SiF_4$. If the field at the extraction slit is on the order of 50 Gauss, the magnetic potential at the aperture should be as low as possible, i.e., ½ B×extraction slit width.

If the main source gas is produced from an oven, such as arsenic or phosphorus, an additive etching gas can be added when the source dielectric wall near the antenna is not hot enough to prevent coating of the dielectric. In this way, a conducting coating can be prevented which would turn off the plasma. In addition, an etching gas may be used for dry cleaning the source.

As noted above, a plurality of inductive/helicon wave plasma sources are formed. The plurality of inductive/helicon sources and their positions result in a reactive plasma which is distributed uniformly around the circumference of the chamber 12. The number of inductive/helicon sources can be varied to fit the desired operating conditions and the result to be achieved.

In a preferred embodiment of the invention, at least some of the plurality of magnetic dipoles 16 associated with the at least one antenna 14 are situated on the at least one antenna 14. In a most preferred embodiment of the invention, each and every one of the plurality of magnetic dipoles 16 assocated with the at least one antenna 14 are situated against the at least one antenna. When there are a plurality of antennas 14, it is most preferred that each and every one of the plurality of magnetic dipoles 16 associated with each antenna 14 be situated against the antennas 14. As shown in FIG. 3, there are three antennas 14 encircling the chamber 12 and each and every one of the plurality of magnetic dipoles 16 associated with the antennas 14 is situated against the antennas 14. The third antenna preferably will not have magnetic dipoles. In this preferred embodiment, a well-confined magnetron-type plasma is produced near this third antenna. This magnetron-type plasma adds to the low pressure capability and ease of starting of the plasma.

As alluded to earlier, the number of antennas 14 and magnetic dipoles 16 will vary depending on the application. It is also within the scope of the invention to have at least some of the plurality of magnetic dipoles at the periphery of the chamber 12 be unassociated with any of the antennas. That is, as shown in FIG. 3, the plurality of magnetic dipoles 16 are associated with the antennas 14. It is within the scope of the invention to have fewer antennas 14 and still have some of the plurality of magnetic dipoles 16 at the periphery of the chamber 12 unassociated with any of the antennas 14. In this case, for example, one of the antennas 14 could be deleted but the magnetic dipoles 16 normally associated with that antenna 14 would remain but would be situated adjacent to vertical section 20 of the chamber 12.

Figure 4A:
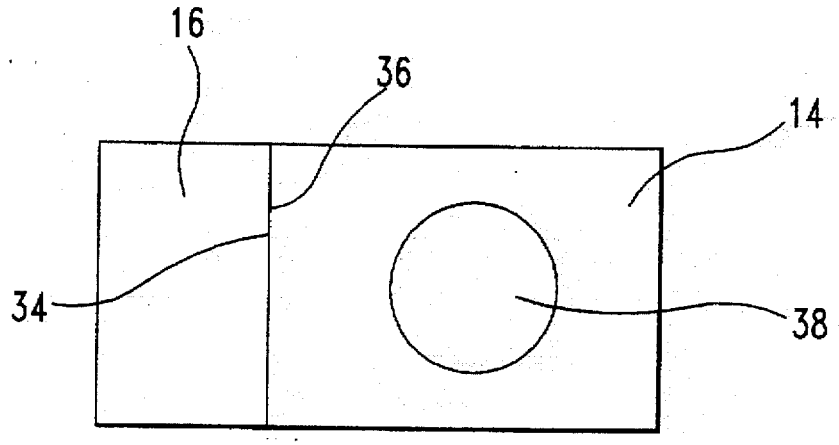
FIGS. 4A and 4B are an enlarged cross-sectional views of an antenna with a magnetic dipole directly against it.

Referring now to FIG. 4A, there is shown an enlargement of the at least one antenna 14 (from FIG. 3) with one of the plurality of magnetic dipoles 16. Water channel 38 is provided in the at least one antenna 14 for cooling if desired. Surface 34 of magnetic dipole 16 is in direct contact with surface 36 of antenna 14. The embodiment shown in FIG. 4A may be made by using cold or hot rolled steel stock (square or rectangular) with a water channel 38 bored lengthwise through the stock. Several lengths of stock may be connected by, for example, mechanical connectors or welding or brazing, to form the antenna 14, which may then be copper plated to a thickness of about 75 microns followed by being silver plated to a thickness of about 10 microns to get good RF conductivity. If water cooling is not necessary, water channel 38 need not be made in the steel stock.

If desired, surfaces 34 and 36 may be separated by ferrite 15 (about 1/16–⅛ inch thick) for electrically isolating magnetic dipole 16 from antenna 14.

Figure 4B:
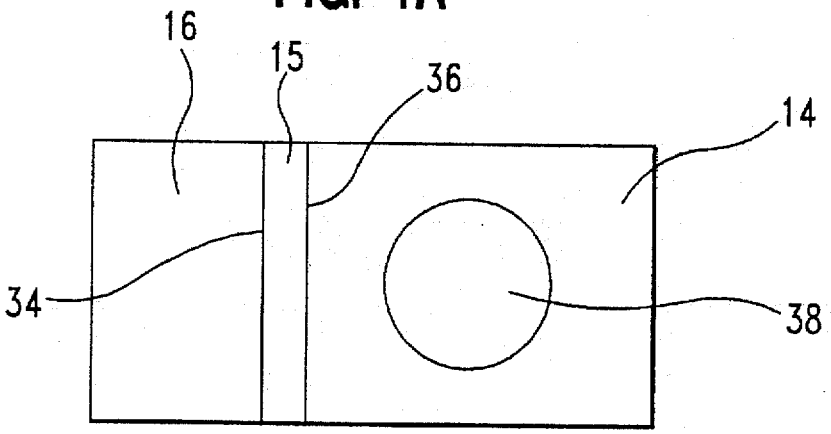

It is most preferred that magnetic dipole 16 be directly against antenna 14, except in the instance where ferrite 15 is interposed between the magnetic dipole 16 and antenna 14 as shown in FIG. 4B.

Figure 5:
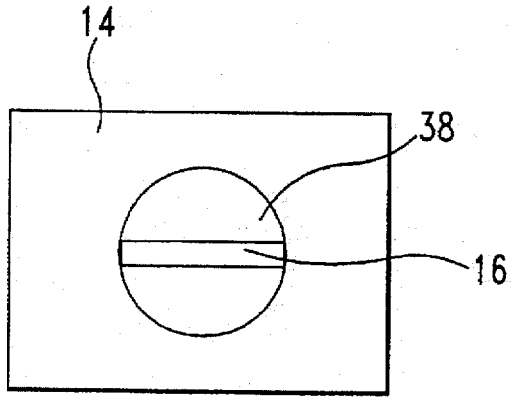
FIG. 5 is an enlarged cross-sectional view of another embodiment of an antenna with a magnetic dipole directly against it.

In FIG. 5, each of the plurality of magnetic dipoles 16 is situated against, preferably directly against, the at least one antenna 14 as discussed previously. In this embodiment, however, the magnetic dipoles 16 are located within the water channel 38 in the at least one antenna 14. Water channel 38 should be sized to allow enough water volume to move through the water channel 38 and around magnetic dipoles 16 so as to provide sufficient cooling capacity. Square or rectangular copper tubing may be used for the antenna 14. After inserting the magnetic dipoles 16, lengths of the copper tubing may be mechanically connected or brazed. The resulting structure may then be silver plated to a thickness of about 10 microns.

The precise orientation of the plurality of magnetic dipoles 16 can be determined based on trial and error, considered in conjunction with the type of magnetic field desired. Generally, the orientation of each of the magnetic dipoles 16 is varied from its neighbor. For one preferred orientation of the plurality of magnetic dipoles 16, as can be seen by comparing FIGS. 1 and 3, the north and south pole of each magnetic dipole 16 alternate in orientation with respect to its neighboring magnetic dipole 16. The inventive apparatus is useful for both plasma etching and plasma coating processes, particularly in fields such as large scale integrated semiconductor devices and packages therefor. With the extraction slit 26, the present invention is particularly suitable for ion implantation. Other fields requiring microfabrication will also find use for this invention.

It will be apparent to those skilled in the art having regard to this disclosure that other modifications of this invention beyond those embodiments specifically described here may be made without departing from the spirit of the invention. Accordingly, such modifications are considered within the scope of the invention as limited solely by the appended claims.

What is claimed is:

1. An ion implantation source for producing a plasma with an electron cyclotron resonance zone comprising:

a chamber for plasma processing and having at least one extraction slit for extracting ions, said extraction slit situated at a first end of said chamber;

at least one loop antenna encircling said chamber for providing a radio frequency induced electromagnetic field to generate an inductive/helicon plasma within said chamber;

a plurality of magnetic dipoles at the periphery of said chamber; and at least one magnetic dipole at a second end of said chamber;

said magnetic dipoles at the periphery and second end of said chamber having their fields directed towards the interior of said chamber, wherein said fields are adjacent to the periphery and said second end of said chamber and keep said plasma spaced from said periphery and said second end of said chamber.

2. The apparatus of claim 1 wherein there are a plurality of magnetic dipoles at said second end of said chamber.

3. The apparatus of claim 1 wherein at least some of said plurality of magnetic dipoles around the periphery of said chamber are oriented adjacent said antenna.

4. The apparatus of claim 1 wherein all of said plurality of magnetic dipoles around the periphery of said chamber are oriented adjacent said at least one antenna.

5. The apparatus of claim 1 wherein there are a plurality of said antennas with each of said antennas encircling said chamber.

6. The apparatus of claim 5 wherein at least some of said plurality of magnetic dipoles around the periphery of said chamber are oriented adjacent said plurality of antennas.

7. The apparatus of claim 5 wherein all of said plurality of magnetic dipoles around the periphery of said chamber are oriented adjacent said plurality of said antennas.

8. The apparatus of claim 1 wherein each of said magnetic dipoles varies in its orientation of the north and south poles from its adjacent magnetic dipole.

9. The apparatus of claim 1 wherein said at least one antenna is located on the exterior of said chamber.

10. The apparatus of claim 1 wherein said chamber comprises a dielectric material.

11. The apparatus of claim 1 wherein said chamber is circular in cross-section.

12. The apparatus of claim 1 wherein said chamber is rectangular in cross-section.

13. The apparatus of claim 1 wherein said at least one antenna also generates a magnetron plasma.

14. An inductive/helicon plasma source for ion implantation comprising:

a chamber for plasma processing and having at least one extraction slit for extracting an ion beam from said chamber;

at least one loop antenna on the outside of said chamber and encircling said chamber for providing a radio frequency induced electromagnetic field to generate an inductive/helicon plasma within said chamber;

a plurality of magnetic dipoles for forming a magnetic field at said at least one antenna, said magnetic field decreasing to the center of said chamber and to said extraction slit where said plasma is being used.

15. The apparatus of claim 14 wherein said at least one antenna also generates a magnetron plasma.

* * * * *